US005207870A

United States Patent [19]

Aho et al.

[11] Patent Number: 5,207,870

[45] Date of Patent: May 4, 1993

[54] PROCESS AND EQUIPMENT FOR PRETREATMENT OF CELLULOSIC RAW MATERIAL

[75] Inventors: Osmo Aho, Kasurisentie 17, 37630 Valkeakoski; Antti Aho, Helsinki, both of Finland

[73] Assignee: Osmo Aho, Valkeakoski, Finland

[21] Appl. No.: 789,638

[22] PCT Filed: Jan. 30, 1989

[86] PCT No.: PCT/FI89/00017

§ 371 Date: Aug. 7, 1990

§ 102(e) Date: Aug. 7, 1990

[87] PCT Pub. No.: WO89/07170

PCT Pub. Date: Aug. 10, 1989

Related U.S. Application Data

[63] Continuation of Ser. No. 543,727, Aug. 7, 1990, abandoned.

[30] Foreign Application Priority Data

Feb. 8, 1988 [FI] Finland ..... 880560

[51] Int. Cl.[5] ..... D21C 1/10

[52] U.S. Cl. ..... 162/53; 162/62; 162/246

[58] Field of Search ..... 162/53, 233, 242, 246, 162/49, 62

[56] References Cited

U.S. PATENT DOCUMENTS

| | | | |
|---|---|---|---|
| 2,508,043 | 5/1950 | Schaefer | 162/62 |
| 2,999,538 | 9/1961 | Hullman | 162/53 |
| 2,999,784 | 9/1961 | Hullman | 162/53 |
| 3,076,501 | 2/1963 | Schinn | 162/53 |
| 3,215,587 | 11/1965 | Guerrieri | 162/53 |
| 3,259,538 | 7/1966 | Schnyder | 162/53 |
| 3,347,741 | 10/1967 | Hutchinson | 162/53 |
| 3,446,701 | 5/1969 | Lloyd | 162/53 |
| 3,652,384 | 3/1972 | Sloman | 162/62 |

FOREIGN PATENT DOCUMENTS

| | | |
|---|---|---|
| 1335/61 | 3/1970 | Finland . |
| 105950 | 11/1942 | Sweden . |
| 135529 | 4/1952 | Sweden . |
| 152117 | 10/1955 | Sweden . |
| 171623 | 6/1960 | Sweden . |
| 178211 | 2/1962 | Sweden . |
| 221866 | 7/1968 | Sweden . |

*Primary Examiner*—Karen M. Hastings

*Attorney, Agent, or Firm*—Burns, Doane, Swecker & Mathis

[57] ABSTRACT

The invention concerns a process for pretreatment of cellulosic chip-formed raw material by impregnation. In the process, first a vacuum treatment is carried out without preceding moistening treatment, and as soon as possible after the vacuum treatment penetration is carried out with a solution of chemicals or with water at the atmospheric or a higher solution pressure. In this way the fiber cavities can be filled optimally, which promotes a uniform and adequate diffusion of the solution into the fiber walls significantly. The process can be carried out, e.g., in a device which comprises a tank (11) for the treatment of the raw material and therein a feed opening (18) for the solution as well as an opening (14) for removal of the raw material, which said opening (14) communicates preferably with a reception tank, wherein the atmospheric or a higher pressure prevails.

9 Claims, 5 Drawing Sheets

%
100
50
1
2
1 2 3 4 5 10 min

%
100
50
4
3
min
9
8
7
6
5
4
3
2
1
20 30 40 50 60 70 80 °C 62
60
S
61

63
65
64
S
60
66

PROCESS AND EQUIPMENT FOR PRETREATMENT OF CELLULOSIC RAW MATERIAL

This application is a continuation of application Ser. No. 07/543,727, filed Aug. 7, 1990, now abandoned.

The present invention concerns a process and an equipment for pretreatment of chip-formed wood or other cellulosic raw-material by impregnation. The invention is in particular concerned with the penetration of the fibrous cell system, taking place as the first step in the impregnation. As the penetration solution, it is possible to use a solution of chemicals or water.

In the technique for the production of paper fibers, the object of the impregnation of the wood chips is to provide a desired amount of solution as uniformly distributed in the fiber walls in the chips. In this way, the detaching of the fibers while they remain as intact as possible and of suitable quality or the dissolution of lignin and of other encrust materials in a later stage of the process is promoted. The factors affecting the impregnation are indefinite and difficult to control, which may result, e.g., in an overdosage of time and chemicals when attempts are made to guarantee an acceptable final result.

In the technical literature in this field, it is suggested that impregnation takes place as a joint effect of two physical factors, penetration and diffusion, which starts immediately after the solution has reached contact with the chips.

The penetration begins primarily from the cut faces of a chip, from which the solution penetrates into the fiber cavities. Owing to the counter-pressure caused by the air present in the cavities, the penetration slows down and stops soon. Almost the only factor that is mentioned as a factor that promotes the penetration is an increase in the difference in pressure between the solution and the air present in the fiber cavities by reducing the component pressure of the air or by increasing the pressure of the liquid.

Compared to penetration, diffusion is very slow. In diffusion the ions are transferred into the fiber walls in the solution because of differences in the concentrations of chemicals. The diffusion proceeds along liquid connections formed by the water which has penetrated into the fibrous cell system or which was present in said cell system.

Raising of the temperature of the penetration solution promotes the mobility of the ions. However, the chemical concentration of the penetration solution has a decisive significance for the progress of the diffusion into the interior parts of the chips, because the diffusion is always retarded when the moisture contained in the chips dilutes the solution and when its chemical content is reduced as chemicals are absorbed into the cell walls.

Thus, the amount and the coverage of the penetration have a highly essential importance for the initiation and progress of the diffusion as well as for the sufficiency and uniformity of the dosage of chemicals in the fiber walls, which is the ultimate goal.

It has been suggested that the amount of air contained in the cell systems in chips be reduced by means of vacuum produced mechanically or by means of steaming. However, only steaming is employed in the industry.

Steaming impregnation is a simple, but not adequate or controlled process if a good and uniform penetration of the chips is desired. For example, it has been proved that, as a result of absorption with the cooking liquor, the chemical concentrations in different parts of a chip particle varied within wide limits and that a considerably long diffusion time with preheating is required before a concentration necessary for the chemical reactions can be obtained in the inner parts.

The use of a vacuum in order to remove air has been suggested, e.g., in the Finnish Patents 11,987 and 30,091, and in the Swedish Patent 135,529.

The publication SE 135,529 deals with a continuous process and with equipment for impregnation of the chips with liquid. The impregnation takes place so that chips are fed continuously into the top portion of a tower, where it enters into a vacuum. The lower end of the tower, whose top end is closed, is placed in water, so that the chip column sinks in the tower slowly downwards and is submerged in the water, being impregnated at the same time. Thereat the pressure of the water surrounding the chips becomes gradually higher, until it reaches the atmospheric pressure as the chips are discharged out of the tower. When a chip particle sinks into water, the pressure of the air present in the fiber cell system is the same as the pressure of the surrounding water, whereby no penetration dependent on pressure gradient takes place. However, the effect of factors that retard penetration, which evolve rapidly, starts immediately.

In the process of the publication FI 30,091 the starting material is first predried to about 18%, and air is removed from it almost completely at an absolute pressure lower than 100 mmHg (about 0.13 bar) and at a temperature of 85° to 90° C. If a higher temperature is used, according to the patent, the vacuum-treatment pressure can be increased up to an absolute pressure of 200 mmHg (about 0.26 bar).

As compared with the very high variations in the contents of air and water in the chips, the changes in the density of the wood material are, as a rule, confined to the range of ±5 . . . 10%, because attempts are made to use the same species of wood and to avoid the parts that are most difficult to impregnate, such as the resinous heartwood of conifer trees.

The moisture content of the chips varies within very wide limits. The chips arriving in the fiber production can normally contain water at a level of 30 to 120% of the dry matter of the chips. In mechanical production processes, the defibration is successful best when the chips are filled with water. In chemical processes, the desired dosage of chemicals must be provided throughout the chips as uniformly diffused. Thereat, the quantity and the chemicals content of the solution to be penetrated into the fiber cell system free from water have an essential effect on the diffusion.

In the cited processes, the impregnation takes place almost exclusively by means of diffusion. Penetration cannot be utilized therein almost at all, being usable at the maximum partially and occasionally.

In the process now invented, a pretreatment in two steps is carried out. The first step is vacuum treatment, and the second step is penetration with a solution of chemicals or with water whose temperature is lower than its boiling point at the vacuum used. The vacuum treatment is carried out without substantial preceding moistening of the raw-material. Here moistening means steaming, washing, or any other, conventional aqueous treatment.

The penetration is carried out rapidly after the vacuum treatment at the atmospheric or a higher solution pressure so that the fiber cavities in the raw-material do not have time to be closed substantially before the penetration. The more rapidly the penetration is carried out, the better. Depending on the conditions and on the species of wood, the vacuum-treated raw-material is subjected to solution pressure, e.g., within about 5 min., best, e.g., in 1 min., most appropriately in 0.5 min. from the vacuum treatment.

The passing of the penetration solution into contact with the raw-material is started preferably while the vacuum is still effective. Optimally, the vacuum is maintained during the whole of the passing of solution. After the desired quantity of solution has been brought into contact with the raw-material, a pressure impact may be applied to the solution additionally.

The vacuum (i.e., subatmospheric pressure) that is used is, e.g., 0.1 to 0.5 bar, optimally 0.2 to 0.4 bar. Thereat, the temperature of the penetration solution is, e.g., 35° to 85° C., optimally 45° to 75° C.

The concentration of chemicals in the penetration solution is advantageously regulated in accordance with the moisture or with the moisture and the density of the raw-material or in accordance with the quantity of the solution to be penetrated.

According to an embodiment, the penetration solution is passed to among the raw-material in the same vessel in which the vacuum treatment was carried out, whereinafter the raw-material is transferred into a reception tank of a higher pressure, where the penetration is completed.

After the penetration, it is advantageous to separate the proportion of the raw-material that did not sink into the solution from the rest of the raw-material.

The equipment in accordance with the invention is provided with a common vessel for vacuum treatment and for penetration, or separate vessels are provided for them.

A common processing vessel may be, for example, a rotor that revolves in a housing and that it open at least at one end. The necessary connecting ducts are fitted on the circumference of the rotor housing.

When separate vessels are used for vacuum treatment and for penetration, between them it is possible to employ a transfer duct whose final end forms a barometric lock between the vessels. In such a case, the transfer duct is preferably extended by a perforated penetration duct. The final end of the transfer duct is appropriately provided with equipment for the removal of contaminations. On the other hand, at the final end of the perforation duct, it is appropriately possible to place an equipment for the removal of unpenetrated raw-material. Penetration liquid can be fed into the transfer duct, in particular into its initial end.

The raw-material can also be passed into the vacuum-treatment tank through a feed-transfer duct passing through the penetration tank so that the initial end of the feed-transfer duct forms a barometric lock between the penetration tank and the vacuum-treatment tank. In such a case, the raw-material must, of course, pass through this lock so that it is substantially not moistened.

The chips are pretreated in accordance with the invention without a moistening substantial from the practical point of view. The walls of the cut-off fibers at the cut-off ends of the chips, in particular those of their parts that contain hemicellulose, viz., absorb water very rapidly and, when they become swollen, contract or block the open cell cavities. Out of said reason, in connection with penetration, vacuum-treated chips should preferably also be surrounded with solution as rapidly as possible. If the chips, however, end up in contact with water before the pretreatment in accordance with the invention, this contact time should, depending on the circumstances, be at the maximum about 1 min., preferably, however, at the maximum about 20 to 30 or 5 to 15 seconds.

According to the process of the present invention, the best penetration is not achieved by means of maximum vacuum, but by making use of the temperature of the penetration liquid, which said temperature is, depending on the wood species, 35° to 85° C. The magnitude of the vacuum pressure is determined so that vaporization of the liquid is still avoided. The necessary vacuum can be produced by means of normal equipment commonly used in the industry at a reasonable cost.

For example, with softwood, the vacuum is advantageously 0.2 to 0.3 bar, and the temperature of the water solution 55° to 70° C.

When the water content of the chips is changed, the amount of the solution that is penetrated is changed in the same proportion, but the total quantity of penetrated solution and water contained in the chips remain at the same level, i.e. said penetration procedure permits equal filling of the cell system independently from the moisture content of the chips. The amount and uniformity of penetration are well reproducible in the process.

When the density of wood varies, the altered solids amount is measured in the form of a corresponding alteration in the penetration solution.

The nature and the pH of the solution of chemicals have no significant effect on the penetration.

The concentration of the solution of chemicals has a minor effect, which is insignificant under the conditions concerned.

If necessary, high concentrations of chemicals are also possible, because it is possible to use temperatures in which the solubilities of the chemicals are good.

BRIEF DESCRIPTION OF THE DRAWINGS

In the following, the process in accordance with the invention and the devices for its application will be described in more detail with reference to the accompanying figures, wherein.

DETAILED DESCRIPTION

In the experiments that were carried out, factory-made chips were used.

For determination of the uniformity of penetration and the level of penetration, it was noticed that determination of the proportion of the chips that sink into the solution or water was a sufficiently accurate procedure.

Figure 1:
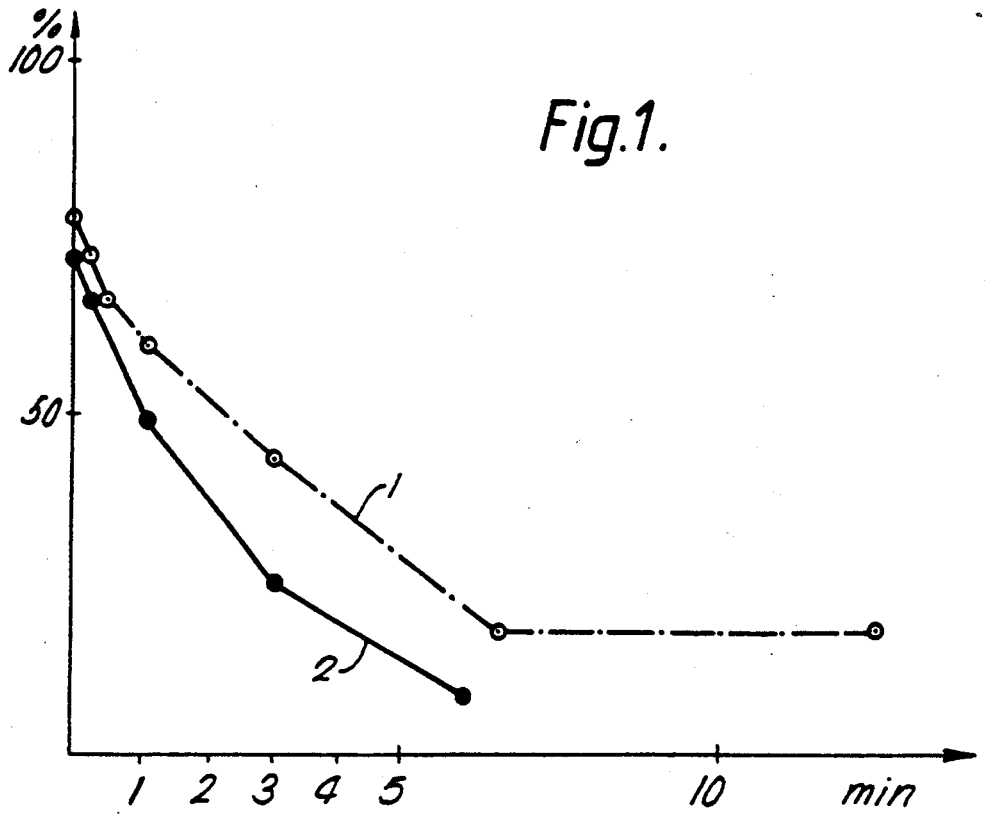
FIG. 1 illustrates the effect of a treatment with a solution of chemicals or with water that precedes the vacuum treatment on the amount of chips that sink into the solution.

From FIG. 1 it is seen how high the negative effect is with a cooking-liquor treatment that precedes the vacuum treatment on the penetrability of cooking liquor. The vertical axis represents the proportion of the chips that sink into the liquor as a percentage of the whole quantity of chips treated, and the horizontal axis represents the duration of effect of the liquor as minutes. In the test, pine chips were used whose moisture content was 21%. The temperature of the treatment solution was 60° C. and the concentration 5%.

The broken line 1 illustrates the proportion of the sinking chips during vacuum penetration when the chips are treated with NSSC-solution. The broken line 2 illustrates the proportion of the sinking chips when the chips are treated with $NaHSO_3$-solution. It is noticed that a treatment for one minute with NSSC-solution already reduces the amount of the sinking proportion by 24%, and a treatment for three minutes by about 45%. The corresponding reductions in the case of treatment with $NaHSO_3$-solution were about 30% and about 70%. In the test a procedure was used wherein the penetration was performed with a cooking liquor subjected to the atmospheric pressure and wherein the filling of the solution was started while the vacuum pressure that had prevailed was still effective.

An explanation of the phenomenon of FIG. 1 is that an aqueous solution has a remarkably rapid effect on the walls and surface properties of capillary cell cavities, whereby, at the cut faces of the chips, the cell systems and in particular the capillaries in summer wood are contracted relatively speaking most rapidly. In this way, the amount of solution that is penetrated, i.e. the proportion of the chips that are sunk into the solution, is lowered rapidly as the soaking time is increased.

Figure 2:
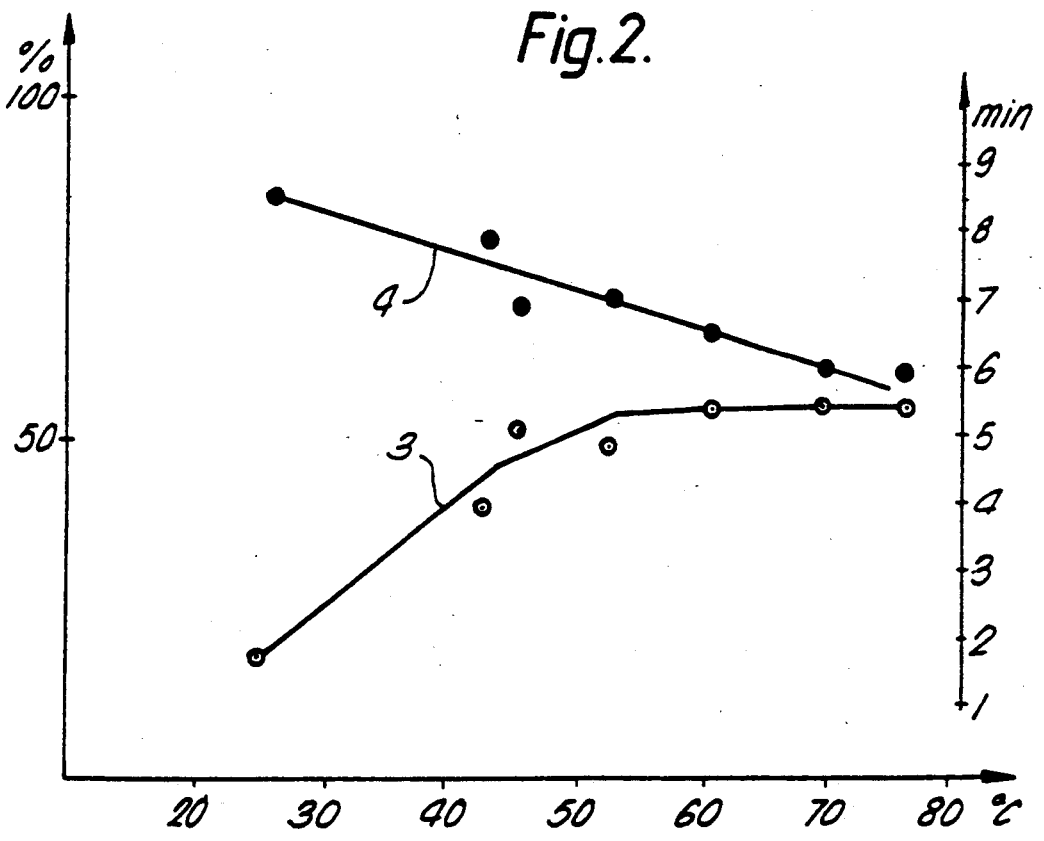
FIG. 2 illustrates the dependence of the penetration on the temperature of the solution or water.

FIG. 2 illustrates the effect of the temperature of the solution on the penetration with different treatment times. The left vertical axis represents the amount of the chips that sink into the solution as a percentage of the entire quantity of chips treated, the horizontal axis represents the temperature of the solution as °C., and the right vertical axis represents the duration of treatment as minutes. In the test the raw-material consisted of pine chips of a moisture content of 20%, which said chips were treated with a 5-% $NaHSO_3$-solution. It is seen that when the temperature of the solution rises from 20° to 50° C., the amount of the chips that sink into the solution (broken line 3) also increases significantly. Likewise, it is seen that a further raising of the temperature does not have a major effect on the result. At the same time with the raising of the temperature of the solution, the treatment time (straight line 4) was shortened in the tests, in spite of which the proportion of sinking chips remained invariable and even became somewhat higher. It comes out from the results unambiguously that the lower limit of the economical operating temperature of the solution is somewhere around 35° to 40° C., whereas, according to the experiments, it is not so useful to heat the material to very high temperatures, because the penetration is not improved essentially. By means of heating, it is, however, possible to intensify the penetration decisively.

Figure 3:
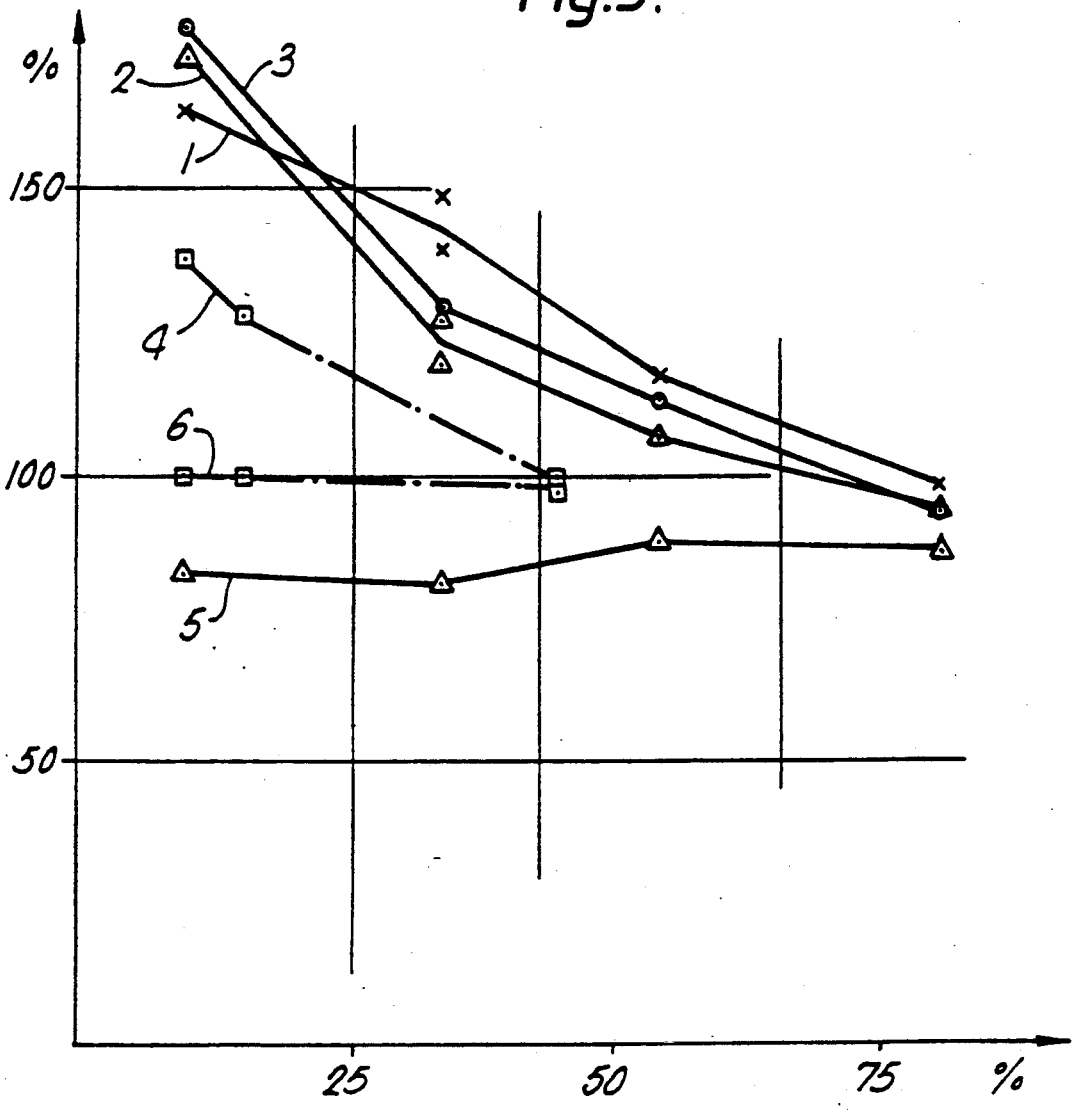
FIG. 3 illustrates the effects of the moisture and the density of the chips on the amount of solution penetrated and on the penetration level.

From FIG. 3 it is seen how the water content of the chips affects the amount of solution that is penetrated. The horizontal axis represents the water content of the chips, and the vertical axis represents the amount of penetrated solution and the amount of chips that sink into the solution, all as a percentage of the dry matter of the chips. In the series of tests, the concentration of the solution of chemicals was 5% and the temperature 65° C. The broken lines 1 to 3 illustrate the penetrations of pine chips 1. with sulphate solution, 2. with NSSC-solution, and 3. with $NaHSO_3$-solution, as well as the broken line 4 illustrates birch chips treated with NSSC-solution. From the broken lines 1 to 3, it comes out that solutions essentially different from each other are penetrated approximately in the same way irrespective of the moisture content of the chips.

With the same chip species, the penetration of a solution of chemicals is determined in an almost linear way by the amount of water contained in the chips. This comes out best from an examination, at the various test points, of the joint effects of the changes in the water contained as moisture in the chips and in the amount of water contained in the solution that penetrated into the chips. In the pine chips, the total water quantity was within the range of 164 to 177%, and in the birch chips within the range of 143 to 145%, respectively. The scattering from the average value was with pine chips ±4% and with birch chips ±1%, The proportion of sinking chips, which was determined by means of a follow-up of the penetration level, was with pine chips 88 to 89% and with birch chips 100%, irrespective of the moisture of the chips (broken lines 5 & 6).

The clear difference in penetration level between the pine and birch chips, seen in FIG. 3, is mainly attributable to different densities of the chips, the density of pine being on the average 0.4 and that of birch 0.5. Here density is understood as meaning the nominal density of the wood species as fully dry.

Since in the case of the different species of wood that are ordinarily used for fiber production, the density of the wood material proper is the same, 1.32 to 1.35, the higher density of birch, which is on the average one quarter higher than the density of pine, means a correspondingly smaller space of fiber cavities, which is also manifested in a corresponding change in the penetrated quantities of NSSC-solution shown in FIG. 3.

In a comparative test carried out with the pine chips and the NSSC-solution quality used in FIG. 3, impregnation by means of steaming was studied. After a steaming time of five minutes, about four fifths of the quantity of solution that penetrated under vacuum in five minutes were absorbed best into dry chips, initially rapidly and in a total of two hours. The penetration level was low in particular in dry chips after steaming, only a small fraction of the amount that sank into the solution on vacuum penetration sank into the solution now. The solution of chemicals was obviously concentrated in the surface portions of the chips, being diluted with the water condensed from the steam.

On the other hand, with the same species of wood, any variations in the quantity of wood material in the cell walls and, at the same time, variations in density are measured as changes in the quantity of solution penetrated like above with varying water contents of the chips.

On the whole, as compared with variations in the water contents, variations in density are so little that for practical purposes it is mostly enough if the joint effect of the water content and the density of the chips is taken into account.

A characteristic feature of conifer wood is dependence of the density on the differences between spring wood and summer wood. The walls of summer-wood fibers are remarkably thicker and the diameters of the cell cavity capillaries are only a fraction of the corresponding dimensions of spring-wood fibers. It has been noticed that the capillary action has a significant part in the penetration. As the lifting force of the solution in a capillary is inversely proportional to the second power of the radius of the capillary, the capillary filling of the fiber cell system starts strongest and most rapidly in the portion of summer wood, provided that a sufficient amount of solution is available in the fiber cavities. It is apparent that the solution pressure formed removes remaining air, and the summer-wood fibers are filled first. This has its significance in view of the initiation of the diffusion and of equalization of the chemicals in the thick-wall fibers in the summer wood. Said assumption is supported, e.g., by the penetration-promoting effect of a vacuum maintained during filling of solution, which had been noticed in the tests.

Birch has no corresponding differences in the structures of the cell systems of summer wood and spring wood. In the tests, this came out clearly in a better level and speed of penetration of birch as compared with pine chips.

Occasional structural differences in wood, such as knots and inclusions caused by resin, have no major significance quantitatively. Unpenetrated portions in cell systems are, in a way, taken into account in a way similar to the cell-wall material, i.e. they have the same effect as an increasing density has.

Figure 4:
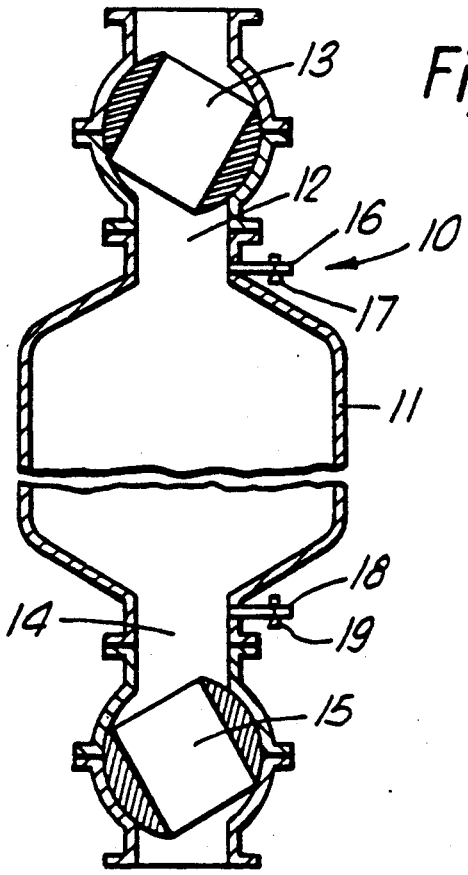
FIG. 4 illustrates a vacuum penetration solution in accordance with an advantageous embodiment of the invention.

The vacuum penetration device 10 that is shown schematically in FIG. 4 consists of a penetration tank 11, into which the chips are introduced through the feed opening 12, to which either a globe valve 13 used for the feed of chips or a chamber feeder or a high-pressure feeder can be connected. At the lower end of the tank 11, there is an outlet opening 14 for the material, and therein a globe valve 15. Vacuum pressure is produced into the tank 11 by means of a connecting duct 16, which is, by means of a valve 17, connected either directly with a vacuum pump or with an intermediate vacuum tank, which is provided so as to accelerate the removal of air. The tank 11 is further provided with a connecting duct 18, through which the penetration solution can be passed into the tank 11 by means of a valve 19, e.g., from a pressure accumulator.

The equipment in accordance with FIG. 4 is used so that the tank 11 is filled through the feed opening 12, whereupon the valve 13 is closed and the valve 17 is opened and air is sucked out of the chips present in the tank 11. The vacuum pressure is allowed to sink to a value at which the penetration solution to be fed in the next step does not yet start vaporizing. In the filling, the vacuum pressure is settled, depending on the species of wood and on the arrangement of equipment, in 0.5 to 5 minutes, whereupon the valve 17 is closed and the valve 19 is opened, said latter valve letting the penetration solution into the tank as rapidly as possible. It is also possible to keep the valve 17 open and to allow the vacuum pressure to act in a way intensifying the penetration during the filling of the solution. In the tests it has been noticed that such a filling is penetrated rapidly and uniformly in a few minutes.

If an increased equipment capacity is desired, it is possible to discharge the filling by means of positive pressure into a pressurized reception tank, wherein the penetration is completed and the diffusion of chemicals can be started by raising the temperature.

Figure 5:
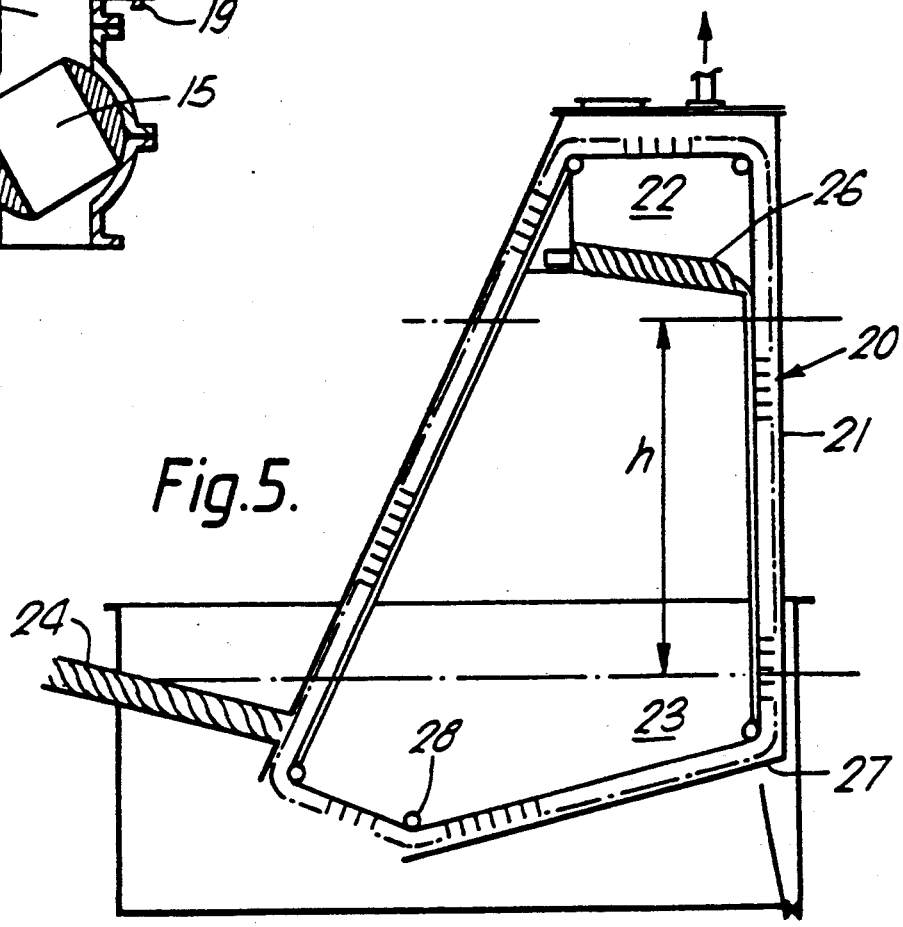
FIG. 5 illustrates a vacuum penetration solution in accordance with another advantageous embodiment.

The equipment 20 shown schematically in FIG. 5 is intended for penetration of, e.g., birch chips and of other hardwood chips of corresponding cell systems which takes place as a continuous flow treatment. The penetration part consists of an arc-shaped transfer duct 21, which extends in its upper part as a vacuum chamber 22. The lower ends of the transfer duct, which act as barometric vacuum locks, are arranged in the tank 23 for the cooking liquor. The level of the liquor is kept constant, and, owing to the vacuum pressure produced in the vacuum chamber 22, the cooking liquor rises in the ends of the transfer duct 21 placed in the soaking basin 23 to the height h corresponding to the vacuum pressure and forms vacuum locks. The chips are fed by means of a screw conveyor 24, at which the surrounding tube 25 is perforated in order that the air surrounding the chips should be able to escape before the chips are transferred onto the endless conveyor in the transfer duct 21. From the rising part of the conveyor 21, the chips are discharged onto the screw conveyor 26 in the vacuum chamber 22. By adjusting the transfer speed of the conveyor 26, the chips can be given the desired time of stay in the vacuum chamber 22, from which the endless conveyor 21 again transfers the chips down into the cooking-liquor basin 23. At the turn 27 of the conveyor 21, it is advantageous to provide separation of sand etc. corresponding contaminations from the chips. At the turning point 28, the portion of the chips that sinks into the solution is discharged out of the transfer duct 21 onto the bottom of the basin 23 so as to be shifted further to the process. The portion that does not sink into the solution, consisting mainly of bark-covered, knotty, etc. poorly penetrated chips, is removed from the surface of the basin 23. By crushing this chip portion further, usable raw-material can be recovered from it.

As regards its construction and operation, the equipment described above is simpler than the solution of FIG. 4 with its numerous valves. Moreover, the cost of producing the vacuum is lower in this case, because most of the air carried along with the chips is already separated in the screw feeder 24 and does not enter into the vacuum system. Actually the only drawback of the equipment in accordance with this embodiment of the invention is the fact that the chips must already be in contact with the cooking liquor before the vacuum treatment, in the screw feeder 24 and in the lower end of the transfer duct 21. However, it has been noticed that, if dimensioned correctly, the conveyor portions inside the liquid are so short that the time of stay of the chips in the solution remains at the level of 5 to 15 seconds. It does not yet have a great significance in the treatment of chips made of easily penetrable wood. The wetting of the chips is reduced further by the air that surrounds the chip particles and that is discharged in the feeder 24 as well as by the vacuum, which starts being effective rapidly increasing from the lower end of the conveyor 21.

Figure 6:
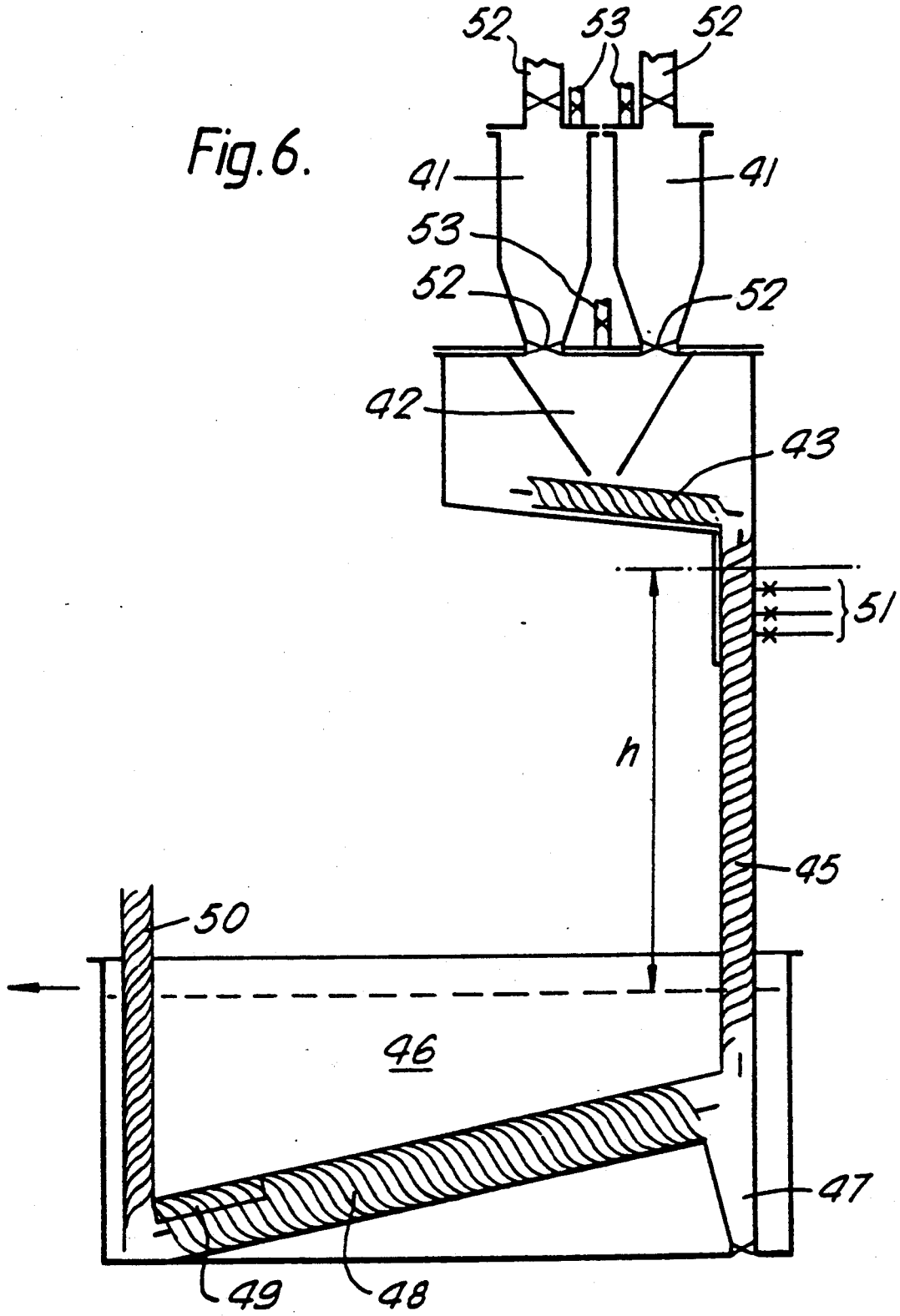
FIG. 6 illustrates a further vacuum penetration solution in accordance with an advantageous embodiment.

In the embodiment of equipment shown in FIG. 6, the drawback of principle mentioned in relation to the device shown in FIG. 5 has been eliminated. The chips are taken alternatingly from two intermediate tanks 41, which can be subjected to vacuum pressure, into a vacuum chamber 42, from which a spiral feeder 43 feeds the chips subjected to vacuum pressure into a conveyor 45, which acts at the same time as a barometric vacuum lock between the vacuum chamber and the chip-reception tank 46. The construction of the conveyor 45 is such that it pulls the chips rapidly from the vacuum into the pressurized basin space. Sand, which is heavier than the chips, and other contaminations are separated at the point 47. By means of a conveyor spiral 48 operating at an adjustable speed, the time of stay of the chips is regulated so as to complete the penetration. At the point 49, the portion of the chips that does not sink into the solution can be separated, e.g., for crushing. The penetrated chips are transferred into the process by means of the conveyor 50. In the reception basin 46, the surface level of the solution is kept invariable. When a certain dosage of chemicals is penetrated into the chips, the solution is fed at the level of the surface formed by the effect of the vacuum at the barometric lock to the point 51, i.e. the difference in height h between the solution surfaces corresponds to the vacuum pressure in the vacuum chamber 43. In the sluicing 52 of the chips, it is possible to use globe or disc valves, sluice feeders or plug screws suitable for the treatment of chips, and for application of vacuum 53, conventional blocking means can be used.

In FIG. 6, it is possible to imagine that the equipment components 41, 52 and 53 are substituted for, e.g. in the penetration of birch chips, by a plug screw press, which feeds the chips into the vacuum chamber 42.

The equipment described above is suitable for continuous penetration of chips, in particular when a certain uniform dosage of chemicals is aimed at. If penetration with water is concerned, the varying requirement of water is taken care of by control of the water level in the reception tank.

Figure 7:
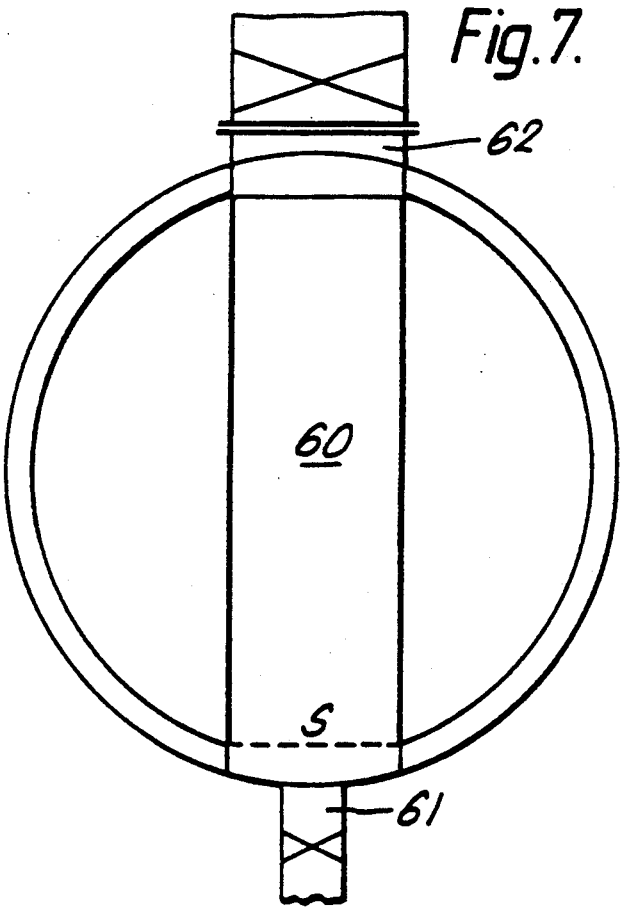
FIGS. 7 and 8 illustrate the steps of operation of a continuous vacuum penetration device.
Figure 8:
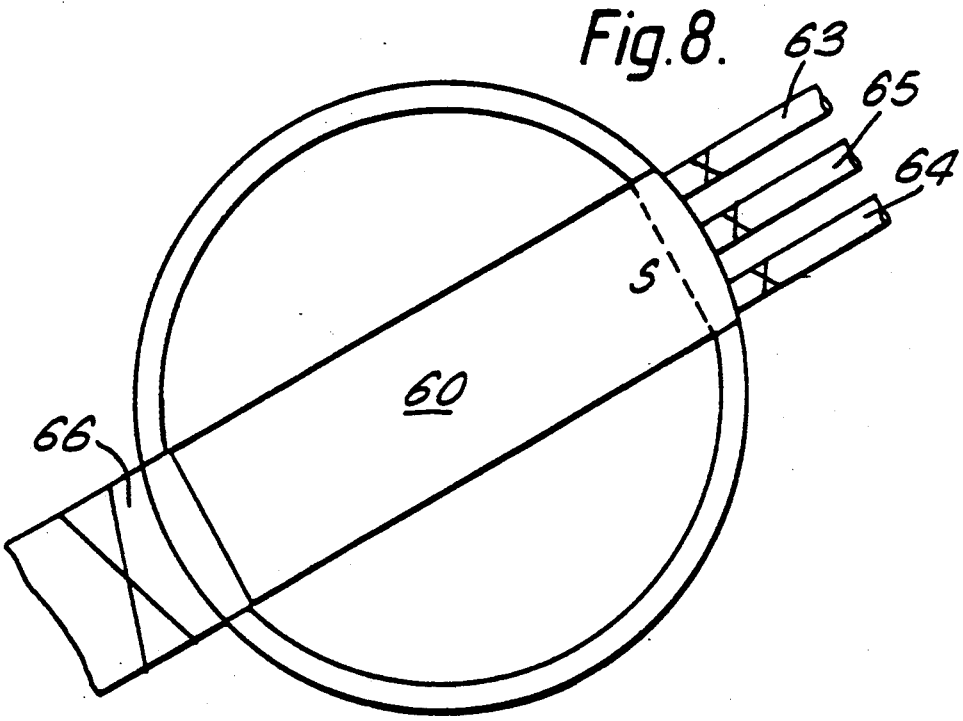

FIGS. 7 and 8 are schematical illustrations of two operating positions of a vacuum penetration device, whose principle of operation is the same as in the device shown in FIG. 4 but in which the chip treatment space is a revolving rotor.

FIG. 7 illustrates the starting situation, in which any transfer solution that remained in the rotor 60 after the preceding processing batch has been removed through the duct 61 and in which the chips are filled through the filling opening 62 while the punched plate placed at the other end of the rotor is in the position S. In FIG. 8, in the position S of the screen plate of the rotor, the chips are first acted upon by vacuum through the duct 63. The penetration solution or water is introduced through the duct 64, and after the filling, either immediately or after a certain incubation time, the treated chips are transferred, by means of a solution taken from the reception tank through the duct 65, through the duct 66 into said reception tank. In the reception tank, it is advantageous, even though not necessary, to maintain a liquid pressure of a few bars. In stead of the reception tank, the further treatment of the chips can also be carried out by using the barometric vacuum lock of the equipment embodiments illustrated in FIGS. 5 and 6. If penetration with water is concerned, the duct 64 is not needed.

The arrangement of equipment described above is suitable, e.g., for the treatment of chips for production of refiner mechanical fibers with water, to which said water it is advantageously possible, if necessary, to dissolve chemicals which improve the control of pH, the yield of fiber, or the colour.

In said devices provided with a rotor, the penetration space must be made relatively small out of constructional reasons. On the other hand, advantages that are obtained are short and rapid vacuum-treatment or solution-filling times and thereby good handling capacity. Rapid and intensive pressure variations on removal of air and on penetration of solution into its place promote opening of the ring pores between the fibers, which improves the level and the speed of penetration.

If necessary, the process of the invention provides the possibility to adjust the dosage of chemicals in the chips, determined in relation to the dry matter, to the desired level by adjusting the concentration of chemicals in the solution to be penetrated. In the following, some examples will be given of the measurement apparatuses and auxiliary devices necessary in that connection, which are suitable for use in connection with all of the above embodiments of equipment for vacuum penetration, the purpose of these examples being to illustrate the requirements to be imposed on said embodiments.

For the measurement of the water content and density of the chips as well as for the transfer and conversion of the measurement results to the control of the chemical concentration of the solution to be penetrated, as a rule, the apparatuses used for said purposes are suitable.

The storage circulation time of chips is normally some weeks. Thereat, extreme conditions of water contents are equalized, and the variations in moisture content in the chips coming to use occur as wave-like variations. Since the density of the wood material in the fiber walls is, with all of the wood species that are concerned, practically the same, 1.32 to 1.35, with some simplification, it is possible to start from the assumption that a flow or batch of chips that represents the same species of wood and the same density and that has been treated at a standardized volume always contains the same weight quantity of dry matter of wood per unit of volume. Thereat, it can also be considered that the total volume of the cell cavities and pores remains at the same level. It follows from this that the difference in weight between the weight of the chips that is measured in each particular case and the weight of the dry matter of the chips, to be considered invariable, which latter weight also includes the variations in the density of the wood material, can be adopted as the joint quantity of the water contained in the chips and of the density differing from the average, which said joint value, when subtracted from said total volume of the cell cavities, gives the cavity volume free from water and from variations in wood density, i.e. the solution volume in which the desired chemical dosage must be present as dissolved.

Under the above prerequisites, the concentration of chemicals $l_k$ (%) in the solution to be penetrated is determined on the basis of the desired chemical dosage b (% of dry matter) and of the joint effect a (% of dry matter) of the water content and density of the chips from the formula $$l_k = \frac{100 \cdot b}{n - a},$$

wherein the value of the factor n is a factor derived from the density of the wood material concerned. Based on experience, the factor n may be made to include an apparatus-specific correction or a correction derived from a desired security or similar factor. For example, with conifer wood at a density 0.4, the value of the factor n is without corrections 176, and with birch at a density 0.6 correspondingly 93. In the formula it is essential that the quantity or the filling density of the chips has no effect on the result.

For constant monitoring of the water content and the weight of chips, e.g., a measurement apparatus is suitable wherein the water content is determined by means of neutron radiation and the weight by means of gamma radiation. If constant monitoring of variations in the density of the chips is necessary, in the measurement area of the conveyor belt the chip flow must be of invariable volume or the measurements must be carried out in a measurement space, in which case the filling density of the chips can be made invariable more readily. Variations in the density of the chips are normally of an order of a few percent so that in most cases it is enough to make corrections to the density only after a certain limit has been surpassed or when the wood species or quality is changed remarkably. In the embodiments of equipment described, rapid and precise treatment of a continuous flow of chips is possible.

A considerably simpler embodiment of equipment, which, yet, operates with sufficient accuracy, is obtained when, on the chips, only the variation in the weight of chips present in an invariable volume and invariable filling density is determined either continuously or by the batch of treatment. In this embodiment, and so also in the embodiment of equipment described above, frozen chips do not cause an error of measurement, but difficulties in the treatment of the chips both in the measurement stage and in the penetration stage could be avoided best by melting the chips and by partly drying the surface moisture, e.g., by means of a warm flow of air. When the wood species or quality is changed essentially, a corresponding correction is made to the control factor. Said mode of operation is advantageous in particular when high-yield pulps are produced by means of penetration devices of the type illustrated in FIGS. 7 and 8.

It is possible to make use of the measurement results obtained from the changes in the quantity of penetrable solution, which said changes are caused by variations in the water content and density of the chips. Thereat the solution volume of the solution penetrable in a flow or batch of chips to be treated is used in the control of the chemical content of the penetration solution for the next chip batch as a guide for the solution volume in which the desired chemical dosage must be contained. The error produced by the delay in this procedure has no significance in practice, because in the chip stores, which are changed relatively slowly, the greatest local differences in moisture content are equalized, and in the chips taken to production the moisture level can be characterized as varying in wave form in stead of abrupt moisture differences. The process can be accomplished by means of simple embodiments of equipment, and therein the control of the regulation of the chemical concentrations in the solution is obtained from measurement of the factually penetrable cavity volume in the chip quality that is being treated at each particular time.

In the embodiments of equipment described above as examples, the chemical concentration of the solution is regulated by means of dosage devices in a separate solution mixer by means of a control obtained from changes in the quantity of penetrable solution, which said changes are caused by the water content, density, and local blocks in the chips. The chemical content of the solution to be penetrated required in each particular case is obtained, e.g., by mixing concentrated chemical solution and chemical solution obtained from a later stage in the process or waste liquor or waste water in a proportion that yields the desired chemical concentration. The concentration of the concentrated solution is adjusted close to the saturation point of the chemical concerned at the treatment temperature used in each particular case.

High chemical concentrations are needed when a higher water content in the chips reduces the "free" fiber cavity space. In such a case, an improved solubility of chemicals of relatively high penetration temperatures is of advantage. If the "free" cavity space in wet chips is not sufficient even when concentrated solutions are used, by means of a uniform and maximally high concentration of chemicals in the chip cell system, a favourable starting situation has been created for diffusion.

For the regulation and transfer of quantities of solutions, it is advantageously possible to use, e.g., metering pumps.

In the mixer, connecting ducts are required, besides for intake of said solution components, also for passing the solution mixture into the penetration space and for recirculation of the chip transfer solution.

The chip transfer solution is taken from the reception tank preferably out of the cylinder surrounding the extended and perforated discharge pipe for the chips, whereat the concentration of the transfer solution is the same or, having been used in the preceding penetration, almost the same. It is also advantageous to use the transfer solution for the preparation of the solution to be penetrated when, with an increasing water content in the chips, the chemical concentration must be increased. When dilution is needed for the solution mixtures, it is possible to use, e.g., washing waters and waste solutions in consideration of their contents of heat and chemicals and the advantages provided by recirculation in the process. In the reception tank, the penetrated chips are surrounded by a warm solution, whose chemical concentration corresponds to the average level of the solution concentrations of the preceding penetration batches, and the diffusion of the chemical ions into the walls of the chip cell systems filled with solution can start immediately. The objective of the impregnation, a desired chemical dosage adequately and uniformly diffused in the wood material, is achieved in a fraction of the time that is usually required in practical impregnation when the major part of the chemicals must be obtained from a solution placed outside the chip particle by means of diffusion.

Intensified penetration reduces the formation of knotter pulp. Further, the amount and quality of knotter pulp can be affected, as was described above, by treating the partly unpenetrated chips, which do not sink into the solution, separately. The separation can be carried out advantageously in the chip reception tank. The incompletely penetrated portion of the chips, to be removed from the top portion of the tank, is preferably reduced to splinters and, after a separate prolonged solution treatment, returned to the process or, in a repeated separation, the knotty or any other poorly defibrizable part of the raw-material is removed.

Separation of mechanical contaminations before the vacuum treatment of the first stage by washing with water cannot be carried out in the process of the invention. In the treatment stages themselves, the chips are, however, subjected to mixing and pressure variations taking place in the solution, which detach contaminations that adhere to the chips quite efficiently. If the requirements imposed on the purity of the chips cannot be met in said treatment, a normal purification treatment is carried out in connection with the further transfer of the chips.

By means of the process and the embodiments of equipment in accordance with the invention described above, an adequate solution filling that is equalized throughout the chips can be penetrated into the chips rapidly and under control. By means of a control obtained from the joint effect of the moisture and, if necessary, density of the chips, the concentration of chemicals can be regulated, when desired, so that the dosage of chemicals in the chips as calculated per its dry matter remains practically at the same desired level. Thereby a favourable starting situation has been created for completion of uniform and complete impregnation of the chips, i.e. for slow diffusion of chemical ions: maximally high concentration of chemicals and temperature in the solution as well as short distance to the reaction points. A controlled and very rapid balanced impregnation of the chips improves the product quality indirectly and provides economies of raw-material and energy. At the same time, the time taken by the process cycle is shortened essentially. In this way, for example, the capacity of existing digesting plants can be improved advantageously.

The procedure is suitable for use in alkaline and neutral digesting processes. It is in particular suitable for the production of high-yield and chemi-mechanical pulps, whereat attempts are made to obtain a high yield and a good fiber quality by means of a little dosage of chemicals and short-time heating, possibly carried out in a steam phase. Further, the use of this process is advantageous in impregnation objects wherein little quantities of chemicals must be distributed uniformly in the raw-material. The objective may be, for example, stabilization of hemicellulose and the use of catalysts or bleaching chemicals. In mechanical production of fibers, the chips may be penetrated with hot water, to which small amounts of chemicals may have been added. The procedure increases the possibilities of using a wood or chip quality inferior to the customary quality, e.g. dried-up sawmill chips in TMP-, CTMP- and CMP-processes.

Besides for the production of fibers, the pretreatment of raw-material in accordance with the invention can, with the arrangements described above, be used in impregnation of a porous cellulosic raw-material, e.g., in the production of boards or when the raw-material is modified chemically, e.g. in converting wood to sugar, or in general in utilization of the constituents of wood.

Above, some advantageous examples have been given of the numerous modifications that are included in the scope of the invention, said modifications being restricted by the accompanying patent claims only.

What is claimed is:

1. A process for the pretreatment of cellulose chips, comprising the steps of:

(a) removing air from the cellulose chips by exposing the chips to subatmospheric pressure;

(b) contacting the chips from step (a) with a penetrating liquid having a temperature lower than the liquid's boiling point at said subatmospheric pressure, said contacting taking place within about 0.5 minute after said exposure to subatmospheric pressure in step (a) and under conditions such that a pressure gradient is maintained between the liquid and the fiber cavities; and (c) exposing the chips and the liquid to a pressure of atmospheric or above within said 0.5 minutes and for a time sufficient to allow the solution to penetrate into the chips;

wherein said subatmospheric pressure in step (a) is from about 0.1 to about 0.5 bar, and wherein the penetrating liquid has a temperature of from about 35° to about 85° C.; and wherein the cellulose chips, prior to removal of air in step (a), are substantially unmoistened.

2. A process as claimed in claim 1, wherein the penetrating liquid is a chemical solution, and wherein the concentration of chemicals in the solution is adjusted in accordance with the moisture, with the moisture and density, or with the quantity of chemical solution, in accordance with the formula $$l_k = \frac{100 \cdot b}{n - a},$$

wherein $l_k$ is concentration of chemicals, a is joint effect of moisture and density, b is dosage of chemicals, and n is a factor of correction factors.

3. A process as claimed in claim 1, wherein the exposure of cellulose chips in step (a) is carried out in a vacuum vessel and the penetrating liquid is thereafter added to the vacuum vessel, and wherein after addition of the penetrating liquid, the chips and liquid are transferred into a reception tank for completion of penetration under a pressure of at least atmospheric.

4. A process as claimed in claim 1, wherein the penetrating liquid comprises a saturated or almost saturated solution of chemicals, a solution of chemicals obtained from the further processing of the cellulose chips, washing water, waste water other than washing water, or a combination thereof.

5. A process as claimed in claim 1, wherein the penetrating solution used in said process prepares the cellulose pulp for an alkaline or neutral digesting process.

6. A process as claimed in claim 1, wherein the penetrating liquid used in said process prepares the cellulose pulp for the mechanical production of fibers.

7. A process in claim 1, wherein the exposure of cellulose chips in step (a) is carried out in a vacuum vessel and the penetrating liquid is thereafter added to the vacuum vessel, and wherein after addition of the penetrating solution, the chips and liquid are transferred into a reception tank for completion of penetration under a pressure of at least atmospheric.

8. A process as claimed in claim 1, including exposing the chips to subatmospheric pressure in step (a) by sequentially placing the chips in a penetration tank, evacuating the penetration tank until the desired subatmospheric pressure is reached and then shutting off the source of vacuum, and thereafter contacting the chips in step (b) by allowing said penetrating liquid to enter the penetration tank.

9. A process as claimed in claim 1, including exposing the chips to subatmospheric pressure in step (a) by sequentially placing the chips in a penetration tank, evacuating the penetration tank until the desired subatmospheric pressure is reached, and thereafter contacting the chips in step (b) by allowing said penetrating liquid to enter the penetration tank, wherein said evacuation is maintained during step (b).

* * * * *